United States Patent [19]

Prigge

[11] Patent Number: 4,734,215

[45] Date of Patent: Mar. 29, 1988

[54] CLEANING COMPOSITION CONTAINING HYDROCARBON MIXTURES

[75] Inventor: Ruediger Prigge, Neu Wulmstorf, Fed. Rep. of Germany

[73] Assignee: Shell Oil Company, Houston, Tex.

[21] Appl. No.: 862,878

[22] Filed: May 13, 1986

[30] Foreign Application Priority Data

May 13, 1985 [DK] Denmark ..... 3517170

[51] Int. Cl.[4] ..... C11D 3/44

[52] U.S. Cl. ..... 252/162; 252/170; 252/364; 134/40

[58] Field of Search ..... 252/162, 170, 171, 364; 134/40

[56] References Cited

U.S. PATENT DOCUMENTS

| | | | |
|---|---|---|---|
| 2,279,001 | 4/1942 | Matheson et al. | 252/170 |
| 3,167,514 | 1/1965 | Baker | 252/170 |
| 3,718,586 | 2/1973 | Rollo et al. | 252/8.55 B |
| 3,745,125 | 7/1973 | Marracani et al. | 252/312 |
| 3,929,680 | 12/1975 | Arai et al. | 252/542 |
| 3,998,743 | 12/1976 | Maly et al. | 252/8.55 B |

FOREIGN PATENT DOCUMENTS

| | | |
|---|---|---|
| 1280259 | 7/1972 | United Kingdom . |
| 2084173 | 4/1982 | United Kingdom . |
| 709670 | 1/1980 | U.S.S.R. . |

*Primary Examiner*—Prince E. Willis

[57] ABSTRACT

A cleansing composition, containing from 85 to 97 parts by weight of an non-aromatic hydrocarbon liquid having an atmospheric initial boiling point of at least 150° C., and from 3 to 15 parts by weight of at least one alkylated aromatic containing at least one alkyl group with from 8 to 18 carbon atoms.

8 Claims, No Drawings

CLEANING COMPOSITION CONTAINING HYDROCARBON MIXTURES

BACKGROUND OF THE INVENTION

The present invention relates to a cleansing composition which is particularly suitable for cleaning greasy and dirty metal and plastic surfaces, for example, engines, pumps, tanks, gears, cars, tiles, floors, and the like.

It is known to use a liquid composition containing a hydrocarbon and at least one hetero atom-containing detergent, e.g., an ether of a polyhydric alcohol, for removing oily and greasy deposits from tanks, pumps, refinery equipment and the like. While such compositions are effective for this service, they are sometimes undesirable from the standpoint of economics and environmental impact. On the one hand, the hydrocarbon component of such compositions is typically an aromatic compound or mixture which is toxic or irritant. In several countries legislation has been put into effect which prevents or limits the use of aromatic hydrocarbon liquids (e.g., benzene) in such cleansing compositions. On the other hand, the hetero atom-containing detergent component of conventional compositions is costly and may have the disadvantageous property of emulsifying oils and/or greases in effluent water.

The present invention provides a cleansing composition has which exhibits exceptionally good cleansing performance, and is also economical and environmentally acceptable. Most particularly, the invention is a cleansing composition which contains specified proportions of an aliphatic hydrocarbon component and an alkylated aromatic component having at least one alkyl group with from 8 to 18 carbon atoms. Very advantageously, this composition does not rely for its performance upon either a cost-increasing hetero atom-containing detergent component or an aromatic hydrocarbon component. There are disclosures in the prior art, i.e., in U.S. Pat. No. 3,998,743, of solvent compositions which contain a liquid aliphatic hydrocarbon. However such compositions are also specified to contain substantial amounts of a liquid aromatic hydrocarbon. United Kingdom patent specification No. 1,280,259 further describes a detergent composition containing an ester, a polyoxyalkylene glycol, and a hydrocarbon solvent which may suitably contain up to 10% by weight, and preferably contains about 3% by weight, of aromatic compounds.

SUMMARY OF THE INVENTION

The present invention therefore relates to a cleansing composition, which consists essentially of (a) from 85 to 97 parts by weight of a non-aromatic hydrocarbon liquid having an atmospheric initial boiling point of at least 150° C., and (b) from 3 to 15 parts by weight of at least one alkylated aromatic having at least one alkyl group with from 8 to 18 carbon atoms.

The presence of the 8 to 18 carbon atom alkyl group in the alkylated aromatic molecule is a critical aspect of the invention from the standpoint of environmental concerns. This long side chain renders the product practically completely biologically degradable. This is especially true of alkylated aromatics having linear alkyl groups, which are therefore preferred. Moreover, the technical properties of linear alkyl groups-containing aromatics, e.g. the solubilizing capacity for greasy substances, are better than those of aromatics containing branched alkyl groups.

The length of the alkyl groups in the alkylated aromatics is also responsible for excellent compatibility of this component with the non-aromatic hydrocarbon liquid component.

DETAILED DESCRIPTION OF THE INVENTION

The alkylated aromatics suitable for use in the invention include alkylated xylenes, toluenes and benzenes. Preferred are alkylsubstituted benzenes, in particular alkyl benzenes containing one linear alkyl group with from 8 to 18, preferably from 10 to 16, carbon atoms. The high boiling points of such alkylbenzenes provides cleansing compositions with flash points sufficiently high to permit their safe use in the cleaning of warm surfaces. It is possible to apply one pure alkylbenzene in the cleansing composition according to the invention. However, from the standpoint of economics, it is less expensive and more feasible to employ mixtures of alkylbenzenes. Further, it is often advantageous to use such mixtures since the different structures of the different alkylbenzenes of the mixture exhibit slightly different solubilizing properties. The composition then has increased flexibility in its performance for the removal of different soils, greases, etc.

The non-aromatic hydrocarbon liquid component consists of aliphatic and/or cyclo-aliphatic compounds. Saturated hydrocarbons are substantially non-toxic and are therefore considered preferred for use in cleansing compositions according to the invention.

This component is non-aromatic in the sense that it is essentially free of any aromatic constituent. Overall, if aromatics are present in the composition, they are present only in incidental amounts, e.g., less than 2%, preferably less than 1.0%, and most preferably no more than about 0.5% by weight. Such small amounts of aromatics may be introduced into the the composition as impurities in the principal components.

The non-aromatic hydrocarbon liquid necessarily has an atmospheric initial boiling point of at least 150° C. As a result, the cleansing composition according to the present invention will have a rather high flash point. This is desirable to permit the safe use of the composition, even on warm equipment surfaces. Preferably, the flash point of the composition as a whole is at least 55° C. (The flash point can be determined, e.g., by the well-known Abel-Pensky Closed Cup method.)

The end boiling point of the non-aromatic hydrocarbon liquid is preferably below 320° C. This end boiling point insures that the saturated aliphatics (paraffins) are not of such high molecular weight that crystallization could occur at operating temperatures, rendering the cleansing composition unpourable. Preferably, the boiling range of the non-aromatic hydrocarbon liquid is from 190° to 250° C.

In broadest terms, the composition of the invention combines between about 85 and 97 parts by weight of the non-aromatic hydrocarbon component with between about 3 and 15 parts by weight of the alkylated aromatic component. The relative proportions of these components can be varied within the specified limits to provide an optimum performance in any given service. In general application, cleansing compositions containing from about 90 to 96 parts by weight of the non-aromatic hydrocarbon liquid and from 4 to 10 parts by weight of at least one alkylated aromatic have been found to be very effective.

In use, the cleansing composition according to the invention is applied to the surface to be cleaned, e.g., by spraying onto the surface or by immersing the soiled object in the composition. Subsequently the cleansing composition, together with soil, grease, and the like, is removed from the object, e.g., by wiping or by rinsing with a stream of water. Although the cleansing composition according to the invention is non-toxic and biologically degradable, it is desirable to avoid run-off of substantial amounts of the cleansing composition after use. Therefore, the used cleansing composition, together with any waste water with which it may be mixed, is preferably collected. Although the cleansing composition according to the invention is hardly compatible with water, it is advantageous to include in the composition a small amount of an additive which renders the composition even more incompatible with water, thereby facilitating a separation of the composition from water, when such a separation is required. Suitable additives are long chain alcohols having from 8 to 20 carbon atoms, either derivatives of alkylene glycols, and hydroxy carboxylic acids having more than 8 carbon atoms. The amount of any such additive is preferably minimized since, although it enhances the incompatibility of the cleansing composition with water, it may slightly reduce the cleansing performance thereof. The cleansing composition according to the present invention preferably contains from 0.1 to 1 part by weight of an additive selected from alcohols having from 8 to 20 carbon atoms, ether derivatives of alkylene glycols and hydroxy-carboxylic acids having more than 8 carbon atoms. Especially preferred additives are mixtures of $C_9$ to $C_{16}$ alcohols with $C_3$ to $C_6$ alkylglycols, such as butylglycol, or with $C_{15-25}$ hydroxycarboxylic acids, such as hydroxystearic acid. The weight ratio of the alcohols to the alkylglycols in such mixtures is preferably from 50:50 to 70:30, whereas the weight ratio of the alcohols to the hydroxycarboxylic acids in such mixtures is suitably from 90:10 to 99:1.

The cleansing compositions according to the present invention may contain minor amounts of other additives such as anti-corrosion compounds like alkylated succinic acid derivatives, or pour point depressants like polyalkyl methacrylates.

Suitably, the cleansing composition according to the present invention consists of from 85 to 97 parts by weight of the non-aromatic hydrocarbon liquid having an atmospheric initial boiling point of at least 150° C., from 3 to 15 parts by weight of at least one alkylated aromatic containing at least one alkyl group with from 8 to 18 carbon atoms and from 0 to 2 parts by weight of one or more additives.

The invention also relates to the use of a cleansing composition as specified above in the cleaning of metal and plastic parts, e.g. engines, tanks, pumps, gears, cars, tiles, floors and the like.

The invention will now be further described by means of the following Example, which is intended to illustrate particular embodiments of the invention, but not to limit its broader scope.

EXAMPLE

Three cleansing compositions according to the present invention were prepared from an aliphatic hydrocarbon liquid, having an initial boiling point of 193° C. and an end boiling point of 247° C. (available under the trademark "SHELLSOL D-60"). This non-aromatic hydrocarbon liquid contained less than 0.5% by mole of total aromatics and less than 5 ppm benzene. This non-aromatic hydrocarbon component was combined with an alkylated aromatic component which was a mixture of linear $C_{13}$–$C_{16}$ alkylbenzenes (the mixture having the following distribution: $C_{13}$ alkylbenzene 2%w, $C_{14}$ alkylbenzene 46%w, $C_{15}$ alkylbenzene 49%w and $C_{16}$ alkylbenzene 3%w, and available under the trade name "DOBANE 124").

Composition I contained 95 pbw (parts by weight) of the aliphatic hydrocarbon liquid and 5 pbw of the alkylbenzenes. Composition II contained 95 pbw of the aliphatic hydrocarbon liquid, 4.5 pbw of the alkylbenzenes, and 0.5 pbw of a mixture of alcohols and a carboxylic acid (comprising 18%w of $C_9$ alcohol, 50%w of $C_{10}$ alcohol and 32%w of $C_{11}$ alcohol, to which alcohols hydroxystearic acid was added in an amount of 1.5%w, based on the total alcohols). Composition III contained 93 pbw of the aliphatic hydrocarbon and 7 pbw of the alkylbenzenes.

The flash points of these compositions were determined (using methods DIN 51755, DIN 51758).

For a test of cleaning performance, a layer of about 200 μm of a soil admixture, comprising 20%w of motor oil, 20%w of gear oil, 10%w of grease, 10%w of sea sand, 0.5%w of bentonite, 30%w of iron oxide and 9.5%w of soot, was applied onto a meal plate (100 mm×50 mm×0.75 mm). The amount of the admixture applied was determined by weighing the plate before and after the application of the soil. Subsequently, the plate was immersed in the cleansing composition, kept there for 5 minutes at 11°–15° C., and then lifted out of the composition. After 3 minutes the plate was rinsed with a mild water jet and dried in a drier at 105°–110° C. Then the plate was weighed and the difference in weight of the soil before and after the cleansing treatment determined. Cleansing performance was calculated as a percentage of the soil removed relative to the total soil initially applied to the surface.

To determine the water incompatibility of the compositions, 5 g of the above-described soil admixture and 20 ml of the cleansing composition were homogenized. The homogenized mixture was added under stirring to 4 liters of water. Subsequently, the stirring was stopped, the mixture was allowed to phase separate, and 2 liters of the water phase was collected. The oil content in the collected water phase was determined according to method DIN 38409-H18.

The results of the cleansing performance and water incompatibility tests are shown in Table I.

TABLE I

| Cleanser Composition | Flash Point °C. | Cleansing Performance % | Oil Content mg/l |
|---|---|---|---|
| I | >55 | >95 | 14 |
| II | >55 | 92 | 12 |
| III | >55 | 99 | 8 |

The results indicate that each of the compositions has an acceptable flash point. In each case the cleansing performance is well above 90%, and the oil content in water is acceptably low.

I claim as my invention:

1. A water-incompatible cleansing composition which consists essentially of (a) from 85 to 97 parts by weight of a hydrocarbon component having an atmospheric initial boiling point of at least 150° C. and an atmospheric end boiling point below 320° C. and consisting essentially of aliphatic and cyclo-aliphatic compounds, and (b) from 3 to 15 parts by weight of one or more alkylated aromatic compounds selected from alkylated xylene, toluene, and benzene compounds having at least one alkyl group with from 8 to 18 carbon atoms.

2. A cleansing composition according to claim 1, wherein the alkylated aromatic compounds have at least one linear alkyl group with from 8 to 18 carbon atoms.

3. A cleansing composition according to claim 2, wherein component (a) has a boiling range in the range from 190° to 250° C.

4. A cleansing composition according to claim 3, wherein the alkylated aromatic compounds are selected from alkylated benzene compounds.

5. A cleaning composition according to claim 4, wherein the linear alkyl group has from 10 to 16 carbon atoms.

6. A cleansing composition according to claim 1, wherein component (a) has a boiling range in the range from 190° to 250° C.

7. A cleansing composition according to claim 1, consisting essentially of between about 90 and 96 parts by weight of component (a) and between about 4 and 10 parts by weight of component (b).

8. A process for cleaning a soiled surface which comprises a step for applying to the surface a composition according to claim 1.

* * * * *